US007848670B2

(12) United States Patent
Takahashi

(10) Patent No.: US 7,848,670 B2
(45) Date of Patent: Dec. 7, 2010

(54) DEVELOPING DEVICE AND IMAGE FORMING APPARATUS

(75) Inventor: Keisuke Takahashi, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 633 days.

(21) Appl. No.: 11/840,326

(22) Filed: Aug. 17, 2007

(65) Prior Publication Data

US 2008/0080883 A1 Apr. 3, 2008

(30) Foreign Application Priority Data

Sep. 28, 2006 (JP) ..... 2006-265324

(51) Int. Cl.
*G03G 15/06* (2006.01)
*G03G 15/18* (2006.01)

(52) U.S. Cl. ..... 399/55; 399/155

(58) Field of Classification Search ..... 399/53, 399/55, 155, 239, 240, 249; 430/117.3, 118.3, 430/118.4

See application file for complete search history.

(56) References Cited

U.S. PATENT DOCUMENTS 5,574,548 A * 11/1996 Iino et al. ..... 399/240

FOREIGN PATENT DOCUMENTS

JP 2005-234430 A 9/2005
JP 2006-030719 A2 2/2006

OTHER PUBLICATIONS

Machine translation of Abe et al. (JP 2005-234430 A2), Listed in IDS.*

* cited by examiner

*Primary Examiner*—David M Gray
*Assistant Examiner*—Rodney Bonnette
(74) *Attorney, Agent, or Firm*—Banner & Witcoff, Ltd

(57) ABSTRACT

A developing device includes an image carrier, a developer carrier, a biasing unit disposed upstream of a developing area, and a controller configured to control the biasing unit, and a cleaning member disposed downstream of the developing area to remove the liquid developing agent remaining on the developer carrier. A latent image held on the image carrier may be developed with the liquid developing agent, including charged toner and a carrier liquid, at the developing area where the developer carrier faces the image carrier. The controller causes the biasing unit to apply a first bias voltage to the surface of the liquid developing agent held on the developer carrier during developing, or a second bias voltage thereto during cleaning.

10 Claims, 3 Drawing Sheets

DEVELOPING DEVICE AND IMAGE FORMING APPARATUS

CROSS REFERENCE TO RELATED APPLICATION

This application claims priority from Japanese Patent Application No. 2006-265324, filed on Sep. 28, 2006, the entire subject matter of which is incorporated herein by reference.

TECHNICAL FIELD

Features described herein relate to a developing device that develops an electrostatic latent image using a liquid developing agent (which may be a developer agent), and an image forming apparatus including such a developing device.

BACKGROUND

Liquid developing devices are known in which an electrostatic latent image is developed using a liquid developing agent. One conventional example discloses a liquid developing device in which a corona charger is disposed upstream of a developing area where a developing roller (developing agent holder or developer carrier) contacts a photosensitive drum. The corona charger charges a liquid developing agent held on the developing roller with a bias voltage having the same polarity as toner particles in the liquid developing agent, thereby compacting (or forcing) the toner particles toward the surface of the developing roller. Accordingly, toner particles transferred to a non-imaging area of an electrostatic latent image are reduced, preventing fogging in a developed image.

The above example also includes a cleaning member provided in the liquid developing device. The cleaning member contacts a surface of the developing roller to remove the excess liquid developing agent remaining on the developing roller after the development of an image.

However, in the liquid developing device having the above-described corona charger, toner particles forced from a surface layer of the liquid developing agent held on the developing roller into a deeper layer of the agent might be compacted in the deep layer. The deeper layer may refer to toner that is closer to the surface of the developing roller, while a surface layer of the toner may exist further away from the surface of the developing roller. In this case, the compacted toner particles may be more difficult to remove, and the developing roller might not be cleaned effectively by the above-described cleaning member alone.

Compacted toner particles could be removed by pressing the cleaning member against the developing roller with an increased contact pressure. In this case, however, the cleaning member might damage the surface of the developing roller.

SUMMARY

In view of the above-described problems, the present application provides a developing device and an image forming apparatus that minimizes fogging in a developed image and improves removal of compacted toner particles from the developer carrier.

A developing device may include an image carrier configured to hold thereon a latent image, a developer carrier configured to hold thereon a liquid developing agent, a biasing unit disposed upstream of a developing area in a rotating direction of the developer carrier, a controller configured to control the biasing unit, and a cleaning member disposed downstream of the developing area in the rotating direction of the developer carrier to remove the liquid developing agent remaining on the developer carrier. The latent image held on the image carrier may be developed with the liquid developing agent, including charged toner and a carrier liquid, at the developing area where the developer carrier faces the image carrier. The controller may cause the biasing unit to apply a first bias voltage to the surface of the liquid developing agent held on the developer carrier such that the charged toner moves from a surface layer to a deep layer of the liquid developing agent, or a second bias voltage thereto such that the charged toner moves from the deep layer to the surface layer of the liquid developing agent, for developing and cleaning operations.

BRIEF DESCRIPTION OF THE DRAWINGS

These and other aspects and advantages will become apparent from the following detailed description when taken in conjunction with the accompanying drawings, in which.

DETAILED DESCRIPTION

The discussion below is made with reference to the accompanying drawings.

For purposes herein, aspects are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developing roller or other systems for conveying developer to the image carrier.

It is noted that various connections are set forth between elements in the following description. It is noted that these connections in general and, unless specified otherwise, may be direct or indirect and that this specification is not intended to be limiting in this respect.

(1) First Illustrative Embodiment

Figure 1:
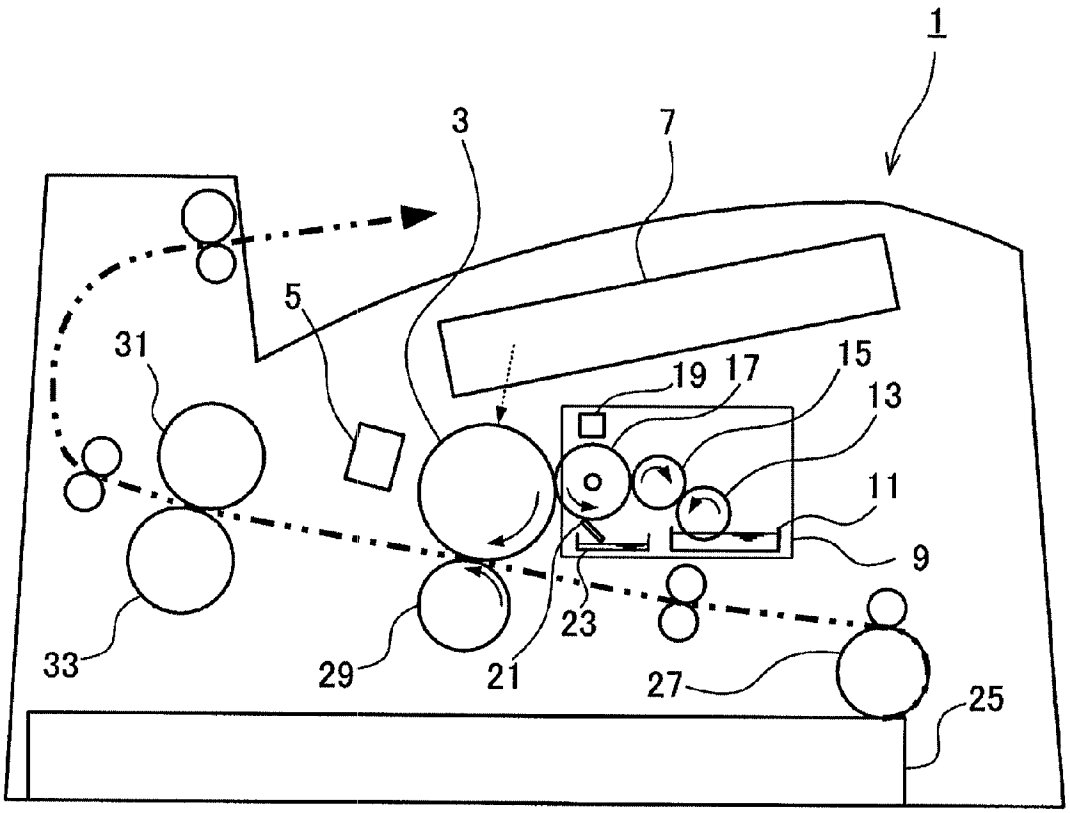
FIG. 1 is a schematic sectional view showing an example image forming apparatus described herein.

FIG. 1 is a schematic sectional view of an image forming apparatus 1 according to a first illustrative embodiment.

The image forming apparatus 1 may include an image carrier (which can be an amorphous silicon drum, and which can be an organic photoconductor (OPC)) 3, a first charger 5, a laser scanner 7, a developing unit 9, a developing agent container 11, a supply roller 13, an intermediate roller 15, a developing roller 17, a second charger 19, a cleaning blade 21, a developing agent dump 23, a sheet cassette 25, a sheet feed roller 27, a transfer roller 29, a heat roller 31, and a pressure roller 33.

The OPC 3 is an example of one of various image carriers. The OPC 3 may be a drum-shaped organic photoconductor that holds a latent image on its outer circumferential surface as an image carrying surface. The OPC 3 is driven by a motor (not shown) to rotate in a predetermined direction (clockwise in FIG. 1).

The first charger 5, which may be implemented by a scorotron, may uniformly charge a portion of the image carrying surface of the OPC 3 that passes the first charger 5.

The laser scanner 7 may emit a laser beam, as shown by a dotted arrow in FIG. 1, based on data representing an image (e.g. data inputted from a personal computer) to form an electrostatic latent image on the image carrying surface of the OPC 3.

The developing unit 9, which may be used for developing an electrostatic latent image, may include a developing agent container 11, a supply roller 13, an intermediate roller 15, a developing roller 17, a second charger 19, a cleaning blade 21, and a developing agent dump 23.

The developing unit 9 may be configured to move between a first position, (shown in FIG. 2A) in which the developing roller 17 is in contact with the OPC 3, and a second position (shown in FIG. 2B), in which the developing roller 17 is away from the OPC 3 and not in contact with the OPC 3.

The developing unit 9 may move to the first position (FIG. 2A) when an electrostatic latent image is being developed, and may move to the second position when the developing roller 17 is being cleaned.

The developing agent container 11 accommodates therein a liquid developing agent that is supplied to the developing roller 17 via the supply roller 13 and the intermediate roller 15. The liquid developing agent may be include silicon oil as a carrier liquid, and may include positively charged toner particles dispersed in the silicon oil.

The supply roller 13 may be driven to rotate in a predetermined direction (such as counterclockwise, as shown in FIG. 1) and supply the liquid developing agent from the developing agent container 11 to the intermediate roller 15 while holding the liquid developing agent on its outer circumferential surface.

The intermediate roller 15 may include recesses on its outer circumferential surface to hold therein a predetermined amount of the liquid developing agent, and may be driven to rotate in a predetermined direction (such as clockwise, as shown in FIG. 1). The intermediate roller 15 may supply a uniform amount of the liquid developing agent to the developing roller 17.

The developing roller 17 is a type of a developer carrier. The developing roller 17 develops a latent image formed on the image carrying surface of the OPC 3 using the liquid developing agent held on the developing roller 17's outer circumferential surface. The developing roller 17 may be driven to rotate in a predetermined direction (counterclockwise in FIG. 1). The OPC 3 may rotate as the developing roller 17 rotates, and the entire image carrying surface of the OPC 3 may make contact with the entire developing agent holding surface of the developing roller 17 through this rotation.

The second charger 19 is an example of a biasing unit. The second charger 19 may electrically charge the surface of the liquid developing agent held on the developing roller 17. The second charger 19 may be implemented by a scorotron.

The cleaning blade 21 may be generally referred to as a cleaning member. The cleaning blade 21 removes the liquid developing agent that remains on the developing roller 17 after development. The liquid developing agent removed by the cleaning blade 21 may be collected in the developing agent dump 23.

The sheet feed roller 27 may feed individual sheets of recording media (e.g., paper) held in the sheet cassette 25 along a path indicated by a double dotted line in FIG. 1.

The transfer roller 29 may cooperate with the OPC 3 to sandwich the sheet fed by the sheet feed roller 27 and transfer a developed image (e.g., a toner image) from the OPC 3 to the sheet.

The sheet containing the toner image may be sandwiched between the heat roller 31 and the pressure roller 33. The rollers 31 and 33 may then apply heat and pressure to the toner image so that the toner image is fixed to the sheet.

Figure 3:
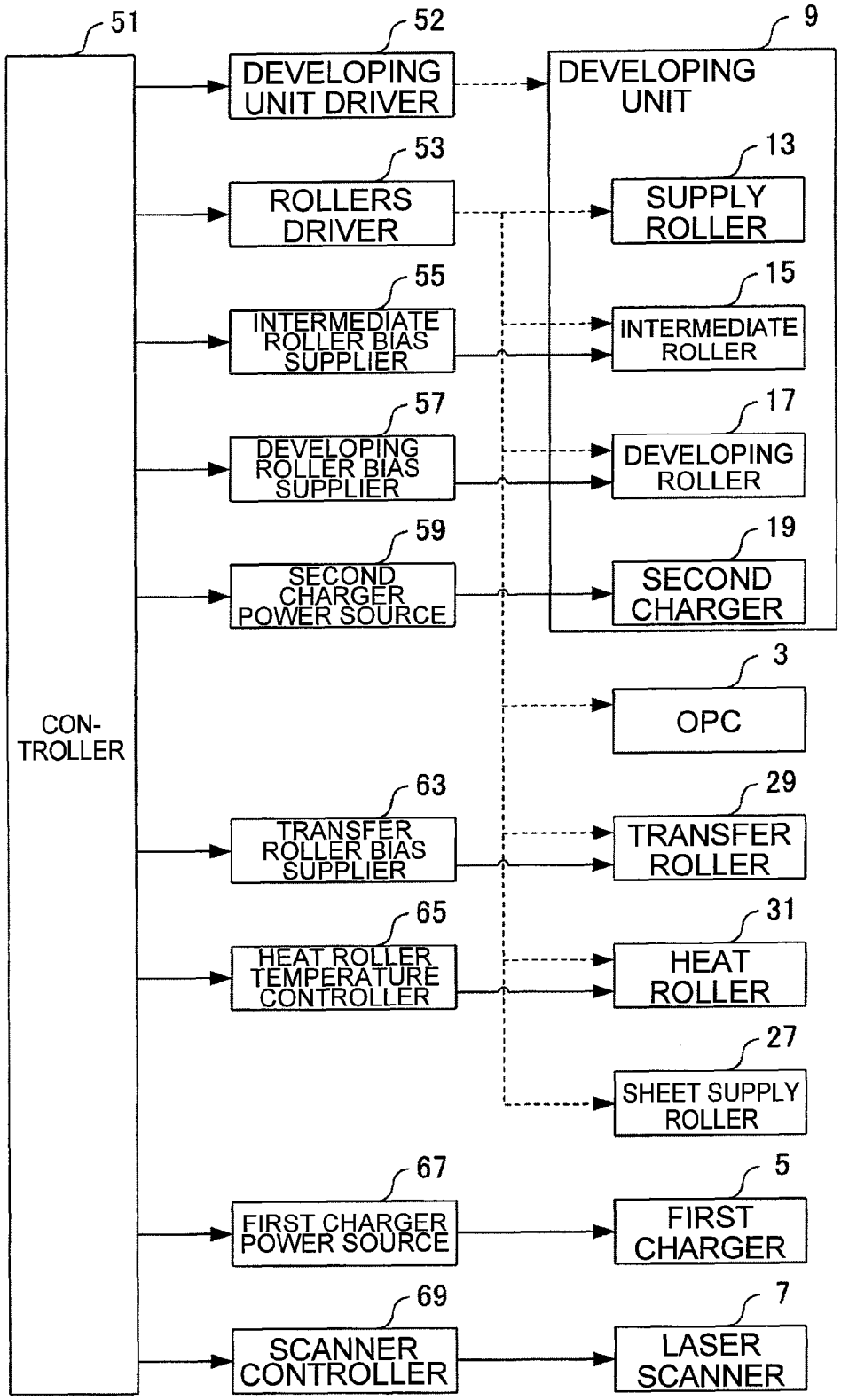
FIG. 3 is a block diagram showing an example image forming apparatus control system described herein.

A configuration of a control system of the image forming apparatus 1 will now be described. As shown in FIG. 3, the image forming apparatus 1 may include a controller 51, a developing unit driver 52, a rollers driver 53, an intermediate roller bias supplier 55, a developing roller bias supplier 57, a second charger power source 59, a transfer roller bias supplier 63, a heat roller temperature controller 65, a first charger power source 67, and a scanner controller 69.

The controller 51 may be a microcomputer configured to control each part of the image forming apparatus 1.

The developing unit driver 52 (which may be the separating unit) may include a motor, a transmission mechanism that transmits drive force from the motor to the developing unit 9, and a drive circuit that controls electric power to be supplied to the motor based on a command from the controller 51. The developing unit driver 52 drives the developing unit 9 to move between the first position (FIG. 2A) and the second position (FIG. 2B) that has been described above, thereby separating the OPC 3 and developing roller 17 as needed. Other structures, such as a solenoid, cam, arm, etc. can be used as well for this separating unit.

The rollers driver 53 may include a motor, a transmission mechanism that transmits drive force from the motor to the rollers in the image forming apparatus 1, and a drive circuit that controls electric power to be supplied to the motor based on a command from the controller 51. The rollers driver 53 may drive the rollers to feed the sheet, supply the liquid developing agent, develop the electrostatic latent image, and transfer and fix the developed toner image to the sheet.

The intermediate roller bias supplier 55 may be a circuit to control the potential of the intermediate roller 15, and may apply a bias voltage to the intermediate roller 15 in accordance with a command from the controller 51.

The developing roller bias supplier 57 may be a circuit to control the potential of the developing roller 17, and may apply a bias voltage to the developing roller 17 in accordance with a command from the controller 51.

The second charger power source 59 may be a circuit to supply electric power to the second charger 19 in accordance with a command from the controller 51 to control corona discharge (discharge bias and grid bias) by the second charger 19.

The transfer roller bias supplier 63 may be a circuit to control the potential of the transfer roller 29, and may apply a bias voltage to the transfer roller 29 in accordance with a command from the controller 51.

The heat roller temperature controller 65 may detect the temperature of the heat roller 31 and supply electric power to the heat roller 31 in accordance with the detected temperature.

The first charger power source 67 may be a circuit to supply electric power to the first charger 5 in accordance with a command from the controller 51 to control corona discharge by the first charger 5. For example, the first charger power source 67 may control a bias voltage applied to the OPC 3 at, for example, its outer circumferential surface.

The scanner controller 69 may be a circuit to control the laser scanner 7 in accordance with a command from the controller 51.

An example developing operation for developing an electrostatic latent image will now be described. In order to develop an electrostatic latent image, the controller 51 may drive the developing unit 9 via the developing unit driver 52 to move the developing unit 9 to the first position (FIG. 2A) where the developing roller 17 contacts the OPC 3.

The controller 51 causes the developing roller bias supplier 57 to supply a bias voltage to the developing roller 17 such that the potential (bias voltage) of the developing roller 17 becomes approximately 700 V. The controller 51 also causes, via the second charger 19 and the second charger power source 59, the discharge bias of the second charger 19 to become approximately 6 kV, and that the grid bias of the second charger 19 becomes approximately 900 V. At this time, a bias voltage of approximately 900 V (for instance, for the first bias voltage) may be applied to the surface of the liquid developing agent held on the developing roller 17.

Then the controller 51 causes the rollers driver 53 to drive the supply roller 13, intermediate roller 15, developing roller 17, sheet feed roller 27, transfer roller 29, heat roller 31, and the pressure roller 33 as described above.

As the rollers are rotating, the liquid developing agent is supplied, due to surface tension, from the intermediate roller 15 to the developing roller 17 at portions where they come in contact. As the developing roller 17 rotates, portions of the developing roller 17 that receive the developing agent from the intermediate roller 15 move to face the second charger 19.

When such a portion of the developing roller 17 faces the second charger 19, the potential difference (effective bias voltage) between the developing roller 17 and the second charger 19 is approximately 200 V; the potential of the second charger 19 is higher than that of the developing roller 17. Thus, positively charged toner particles in the liquid developing agent held on the surface of the developing roller 17 are repelled from the second charger 19 (surface layer of the liquid developing agent) and attracted to the developing roller 17 (deep layer of the liquid developing agent).

When the developing roller 17 rotates further, the portion of the developing roller 17 having faced the second charger 19 reaches a developing area where the portion contacts the OPC 3. An electrostatic latent image held on the OPC 3 includes an imaging area and a non-imaging area. The imaging area may be an area radiated with the laser beam from the laser scanner 7, and may have a potential of approximately 200 V. The non-imaging area may be an area not radiated with the laser beam from the laser scanner 7, and may have a potential of approximately 1000 V.

The potential difference between the developing roller 17 and the imaging area on the OPC 3 may be approximately 500 V, where the potential of the developing roller is higher than that of the imaging area. Thus, positively charged toner particles in the liquid developing agent are repelled from the developing roller 17 and attracted to the imaging area of OPC 3.

The potential difference between the developing roller 17 and the non-imaging area on the OPC 3 may be approximately 300 V, where the potential of the developing roller is lower than that of the non-imaging area. Thus, positively charged toner particles in the liquid developing agent remains on the developing roller 17 without moving to the non-imaging area of the OPC 3.

As a result, only the imaging area of the electrostatic latent image held on the OPC 3 is inked with toner particles.

In some cases, a certain amount of carrier liquid contained in the liquid developing agent might move, due to surface tension, from the developing roller 17 to both of the imaging and non-imaging areas of OPC 3. If toner particles are floating in the surface layer of the liquid developing agent, such toner particles might move, along with the carrier liquid, to the non-imaging area of the OPC 3, causing fogging in the non-imaging area.

In the system described above, however, toner particles floating in the surface layer of the liquid developing agent on the developer roller 17 may move, by the charge from the second charger, to the deep layer of the liquid developing agent before the carrier liquid is rotated to contact the OPC 3. Accordingly, the amount of such floating toner particles are reduced, thereby reducing fogging during the development of an electrostatic latent image.

When the developing roller 17 rotates further, the portion of the developing roller 17 leaving contact with the OPC 3 moves into contact with the cleaning blade 21. At this position, the liquid developing agent remaining on the developing roller 17 is removed by the blade 21. As the developing roller 17 rotates further, the portion of the developing roller cleaned by the blade 21 contacts the intermediate roller 15, and the series of operations described above may be repeated as long as the developer roller 17 rolls in the developing operation.

An example cleaning operation for cleaning the developing roller 17 will now be described. As described above, the second charger 19 moves toner particles to the deep layer of the liquid developing agent to reduce fogging during the development. In this case, however, the toner particles moved to the deep layer of the liquid developing agent might be compacted. The toner particles deposited to the developing roller 17 might not be completely removed by the cleaning blade 21 alone.

In order to remove such toner particles, alternative cleaning of the developing roller 17 may be performed. The controller 51 may drive the developing unit 9 via the developing unit driver 52 to move the developing unit 9 to the second position where the developing roller 17 is away from the OPC 3 (FIG. 2B).

The controller 51 causes the developing roller bias supplier 57 to charge the developer roller 17 such that the potential (bias voltage) of the developing roller 17 becomes approximately 700 V. The controller 51 causes the second charger power source 59 to charge the second charger 19 such that the discharge bias of the second charger 19 becomes approximately 6 kV, and that the grid bias of the second charger 19 become approximately 500 V. At this time, a bias voltage of approximately 500 V (for instance for the second bias voltage) may be applied to the surface of the liquid developing agent held on the developing roller 17.

Also, the controller 51 causes the rollers driver 53 to drive the supply roller 13, intermediate roller 15, and the developing roller 17. The rollers driver 53 may include a clutch mechanism that partially disconnects the drive force transmission path so as not to transmit the drive force to any rollers that need not be driven during cleaning.

In this state, when the developing roller 17 rotates, the potential difference (effective bias voltage) between the developing roller 17 and the second charger 19 at a position where the developing roller 17 faces the second charger 19 becomes approximately 200 V, where the potential of the developing roller 17 is higher than that of the second charger 19.

Accordingly, positively charged toner particles in the liquid developing agent held on the surface of the developing roller 17 are repelled from the developing roller (deep layer of the liquid developing agent), and are attracted to the second charger (surface layer of the liquid developing agent). Compacted toner particles in the deep layer of the liquid developing agent may be forced to the surface layer of the liquid developing agent.

As the developing roller 17 rotates, a portion of the developing roller 17 that has faced the second charger 19 contacts the cleaning blade 21. In this position, the toner particles having moved to the surface layer of the liquid developing agent are removed by the cleaning blade 21.

Then, as the developing roller 17 rotates, the portion leaving the cleaning blade 21 contacts the second charger 19 again, and the series of operations described above may be repeated as long as the developer roller 17 rolls in the cleaning operation.

As a result, the toner particles compacted on the developing roller 17 may be gradually removed, and the developing roller 17 is cleaned. The potential difference between the developing roller 17 and the second charger may be switched to and kept at approximately 200 V while the developing roller 17 makes at least one full rotation so that the entire surface of the developing roller 17 is cleaned.

The above-described cleaning may be performed at any timing except when developing is being performed. For example, cleaning may be performed immediately after the power of the image forming apparatus 1 is turned on. Or, cleaning may be performed immediately before printing is started or immediately after printing is completed in the image forming apparatus 1.

Alternatively, when a plurality of images is continuously developed, cleaning may be performed at an interval after developing a certain image is completed and before the next image is developed. In this case, cleaning may be performed each time a single image is developed or each time a predetermined number of images (i.e. 50 images) are developed.

Alternatively, cleaning may be performed when the developing roller 17 becomes dirty beyond a predetermined level which may be detected by an optical sensor or the like. Or, cleaning may be performed when a predetermined period of time elapses after the previous cleaning.

Alternatively, cleaning may be performed in response to a predetermined operation by the user through an operation panel or a personal computer connected to the image forming apparatus.

Cleaning commanded by the user may be performed more elaborately than in other cases (e.g., when cleaning is performed immediately after the power of the image forming apparatus 1 is turned on). For example, a more elaborate cleaning may be performed by prolonging a cleaning period or by applying a higher bias voltage to the surface of the liquid developing agent held on the developing roller 17 such that toner particles move further away from the developing roller 17.

As described above, in the image forming apparatus 1 according to the first illustrative embodiment, by switching a bias voltage applied to the second charger 19 to approximately 900 V, that is, by switching the effective bias voltage to approximately 200V such that the potential of the second charger 19 is higher than that of the developing roller 17, toner particles in the surface layer of the liquid developing agent may be compacted to the deep layer thereof. Accordingly, fogging in the non-imaging area is reduced during developing.

On the other hand, when a bias voltage applied to the second charger 19 is switched to approximately 500 V (when the effective bias voltage is switched to approximately 200 V such that the potential of the developing roller 17 is higher than that of the second charger 19), toner particles compacted in the deep layer of the liquid developing agent are forced to the surface layer thereof. Accordingly, toner particles can be removed by the cleaning blade 21 more effectively during cleaning of the developing roller 17.

Because prevention of fogging and effective cleaning may be accomplished by providing the single second charger 19, as described above, the image forming apparatus 1 can be made having a simpler structure compared with a case where separate devices are used for preventing fogging and improving cleaning.

In addition, the developing unit 9 may be driven such that the OPC 3 is away from the developing roller 17 during cleaning, thereby preventing toner particles from moving from the developing roller 17 to the OPC 3.

Furthermore, a bias voltage of approximately 500 V is kept applied to the second charger while the developing roller 17 makes at least one full rotation during cleaning. Accordingly, the entire surface of the developing roller 17 can be cleaned.

(2) Second Illustrative Embodiment

An image forming apparatus according to a second illustrative embodiment will now be described. The second illustrative embodiment has basically the same structure as the first illustrative embodiment except for a part of the structure. Differences from the first illustrative embodiment will be mainly described in detail below. The same reference numerals are used for the same parts as those in the first illustrative embodiment, and detailed descriptions thereof are omitted. The second illustrative embodiment is different from the first illustrative embodiment in that the image forming apparatus 1 lacks a developing unit driver 52 and that a developing unit 9 is immovable. More specifically, the developing unit 9 is maintained at a position shown in FIG. 2A and is not moved to a position shown in FIG. 2B to switch between developing and cleaning operations.

Figure 2A:
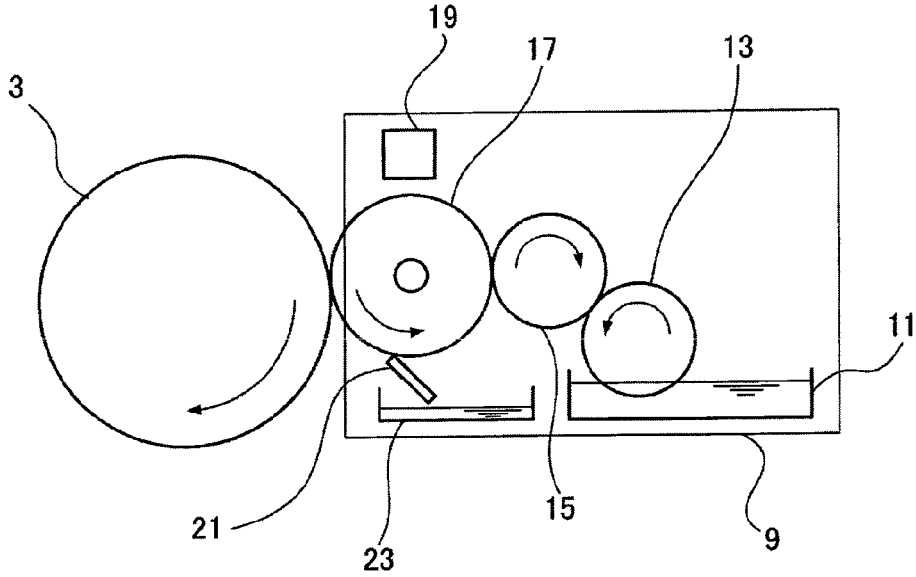
FIG. 2A is an explanatory diagram showing operations of an example developing device described herein.
Figure 2B:
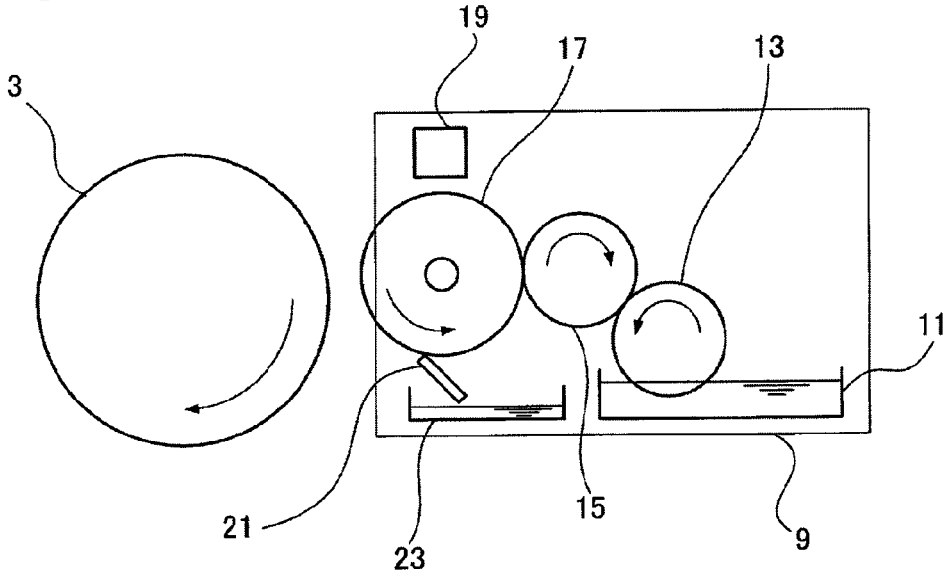
FIG. 2B is an explanatory diagram showing operations of an example developing device described herein.

The developing unit 9 is at the position shown in FIG. 2A when an electrostatic image is developed through operations of each part of the image forming apparatus 1 in the same manner as in the first illustrative embodiment.

During cleaning, the developing roller 17 is kept in the position shown in FIG. 2A, and is not moved to the position shown in FIG. 2B.

Accordingly, during cleaning, toner particles on the developing roller 17 might move to the OPC 3 due to contact between the OPC 3 and the developing roller 17, soiling the OPC 3 during cleaning.

In the second illustrative embodiment, the potential difference between the OPC 3 and the developing roller 17 may be controlled to prevent toner particles on the developing roller 17 from moving to the OPC 3. Operations for cleaning the developing roller 17 in this illustrative embodiment will be described in detail below.

As shown in FIG. 2A, the developing unit 9 may be disposed at such a position that the developing roller 17 contacts the OPC 3.

The controller 51 causes the developing roller bias supplier 57 to charge the developing roller 17 such that the potential (bias voltage) of the developing roller 17 becomes approximately 700 V. The controller 51 causes the second charger power source 59 to charge the second charger 19 such that the discharge bias of the second charger 19 becomes approximately 6 kV and that the grid bias of the second charger 19 becomes approximately 500 V. At this time, a bias voltage of approximately 500 V (for instance for the second bias voltage) may be applied to the surface of the liquid developing agent held on the developing roller 17.

In the second illustrative embodiment, the controller 51 causes the first charger power source 67 to charge the OPC 3 such that the potential of the OPC 3 becomes approximately 800 V. Also, the controller 51 causes the rollers driver 53 to drive the supply roller 13, intermediate roller 15, and the developing roller 17. The rollers driver 53 may include a clutch mechanism that partially disconnects the drive force transmission path so as not to transmit the drive force to any rollers that need not be driven during cleaning.

In this state, when the developing roller 17 rotates, the potential difference (effective bias) between the developing roller 17 and the second charger 19 at a position where the developing roller 17 faces the second charger 19 becomes approximately 200 V, where the potential of the developing roller 17 is higher than that of the second charger 19.

Accordingly, positively charged toner particles in the liquid developing agent held on the surface of the developing roller 17 are repelled from the developing roller (deep layer of the liquid developing agent) and attracted to the second charger (surface layer of the liquid developing agent). Compacted toner particles in the deep layer of the liquid developing agent are forced to the surface layer of the liquid developing agent.

As the developing roller 17 rotates, a portion of the developing roller 17 that has faced the second charger 19 reaches a position where the portion contacts the cleaning blade 21. In this position, the toner particles having moved to the surface layer of the liquid developing agent are removed by the cleaning blade 21.

Then, as the developing roller 17 rotates, the portion from which the liquid developing agent has been removed by the cleaning blade 21 reaches a position where the portion contacts the second charger 19 again, and the series of operations described above may be repeated continuously as the developing roller 17 rolls in this cleaning operation.

As a result, the toner particles compacted on the developing roller 17 may be gradually removed, and the developing roller 17 is cleaned. The potential difference between the developing roller 17 and the second charger 19 may be switched to and kept at approximately 200 V while the developing roller 17 makes at least one full rotation so that the entire surface of the developing roller 17 is cleaned.

In this illustrative embodiment of a cleaning operation, as the developing roller 17 rotates, the portion of the developing roller 17 that has faced the second charger 19 contacts the OPC before making contact with the cleaning blade 21.

As described above, when the controller 51 switches the potential of the developing roller 17 to approximately 500 V, the controller 51 controls the potential difference between the OPC 3 and the developing roller 17 to be approximately 100V. The potential of the OPC 3 is higher than that of the developing roller 17 such that positively charged toner particles are repelled from the OPC and attracted to the developing roller.

Accordingly, although the OPC 3 is constantly in contact with the developing roller 17, transfer of toner particles from the developing roller 17 to the OPC 3 is minimized when the developing roller 17 is cleaned.

Transfer of toner particles from the developing roller 17 to the OPC 3 can be minimized during cleaning of the developing roller 17 by adjusting the potential of the OPC 3 to be higher than that of the developing roller 17. However, if the potential of the OPC 3 is too much higher than that of the developing roller 17, toner particles having moved to the surface layer of the liquid developing agent by the second charger might move back to the deep layer thereof.

Thus, it is preferable that the potential difference between the OPC 3 and the developing roller 17 is adjusted to as small a value as possible in the range that can prevent transfer of toner particles from the developing roller 17 to the OPC 3. For example, the potential of the OPC 3 may be adjusted higher than that of the developing roller 17 by approximately 100 V. Accordingly, toner particles having moved to the surface layer of the liquid developing agent may avoid moving back to the deep layer thereof.

As described above, in the image forming apparatus 1 according to the second illustrative embodiment, by switching a bias voltage applied to the second charger 19 to approximately 500 V, that is, by switching the effective bias voltage to approximately 200V such that the potential of the developing roller 17 is higher than that of the second charger 19, toner particles in the deep layer of the liquid developing agent may be dispersed to the surface layer thereof. Accordingly, cleaning of the developing roller 17 can be effectively performed by the cleaning blade 21.

In the second illustrative embodiment, by adjusting the potential difference between the OPC 3 and the developing roller 17 such that charged toner particles are repelled from the OPC 3 and attracted to the developing roller 17, transfer of charged toner particles to the OPC 3 is minimized during cleaning.

While the features herein have been described in conjunction with specific illustrative embodiments thereof, it is evident that many alternatives, modifications and variations may be apparent to those skilled in the art.

In the above-described embodiments, although the second charger 19 implemented by the scorotron is used as an example of a biasing unit, other biasing units may be used as long as they apply bias voltages to the surface of the liquid developing agent held on the developing roller 17.

For example, a corotron or a biasing film that is disposed in contact with the developing roller 17 may be used as the biasing unit.

A biasing film made of mold-releasable material such as fluorine resin material may be arranged so as to contact the developing roller 17. By application of a high voltage to the film, the potential difference between the film and the developing roller 17 can be created, thereby applying a bias voltage to the surface of the liquid developing agent held on the developing roller 17.

Although, in the above-described embodiments, specific values are indicated as the potential of the developing roller 17 and the potential of the second charger 19, these values are examples and may be changed as long as a desired potential difference is created.

The potential of the developing roller 17 and the potential of the second charger 19 may be determined in relative relation to each other so as to create a desired potential difference, regardless of whether the potentials of the developing roller 17 and the second charger 19 are positive or negative with respect to a reference value (0 V).

As for the potential between the developing roller 17 and the second charger 19, the determination of which should have the higher potential can be determined according to the moving direction of toner, and the property of toner. For example, when negatively charged toner is used, relative potentials between the developing roller 17 and the second charger 19 become opposite to that in the above-described embodiments.

The features as set forth herein are intended to be illustrative, not limiting. Various changes may be made without departing from the spirit and scope of the inventions as defined in the following claims.

What is claimed is:

1. A developing device comprising:

an image carrier configured to hold thereon a latent image;

a developer carrier configured to hold thereon a liquid developing agent including charged toner and a carrier liquid and to develop the latent image with the liquid developing agent at a developing area where the developer carrier faces the image carrier;

a biasing unit disposed upstream of the developing area in a rotating direction of the developer carrier and configured to apply bias voltages to a surface of the liquid developing agent held on the developer carrier, the bias voltages including a first bias voltage for moving the charged toner from a surface layer to a deep layer of the liquid developing agent held on the developer carrier, and a second bias voltage for moving the charged toner from the deep layer to the surface layer of the liquid developing agent;

a controller configured to cause the biasing unit to selectively apply one of the first bias voltage and the second bias voltage to the surface of the liquid developing agent held on the developer carrier; and a cleaning member disposed downstream of the developing area in the rotating direction of the developer carrier and configured to remove the liquid developing agent remaining on the developer carrier.

2. The developing device according to claim 1, wherein when the controller causes the biasing unit to apply the first bias voltage to the surface of the liquid developing agent held on the developer carrier, a potential difference is created between the surface of the liquid developing agent and the developer carrier such that the charged toner moves from the surface layer to the deep layer of the liquid developing agent.

3. The developing device according to claim 1, wherein when the controller causes the biasing unit to apply the second bias voltage to the surface of the liquid developing agent held on the developer carrier, a potential difference is created between the surface of the liquid developing agent and the developer carrier such that the charged toner moves from the deep layer to the surface layer of the liquid developing agent.

4. The developing device according to claim 1, wherein in a developing operation, the controller causes the biasing unit to apply the first bias voltage to the surface of the liquid developing agent held on the developer carrier.

5. The developing device according to claim 1, wherein in a cleaning operation, the controller causes the biasing unit to apply the second bias voltage to the surface of the liquid developing agent held on the developer carrier.

6. The developing device according to claim 1 further comprising:

a separating unit configured to separate one of the image carrier and the developer carrier from the other when the controller causes the biasing unit to apply the second bias voltage to the surface of the liquid developing agent held on the developer carrier.

7. The developing device according to claim 1, wherein when the controller causes the biasing unit to apply the second bias voltage to the surface of the liquid developing agent held on the developer carrier, a potential difference is created between the image carrier and the developer carrier such that the charged toner is repelled from the image carrier and attracted to the developer carrier.

8. The developing device according to claim 1, wherein the cleaning member comprises a blade that contacts the developer carrier and scrapes the liquid developing agent remaining on the developer carrier.

9. The developing device according to claim 1, wherein the controller causes the biasing unit to keep applying the second bias voltage to the surface of the liquid developing agent held on the developer carrier while the developer carrier makes at least one full rotation.

10. An image forming apparatus comprising:

the developing device according to claim 1;

a sheet feeder configured to feed a sheet along a sheet feed path; and an image transfer unit disposed to face the image carrier across the sheet feed path and configured to transfer an image developed from the latent image to the sheet fed along the sheet feed path.

* * * * *